US009427375B2

(12) United States Patent
Ma

(10) Patent No.: US 9,427,375 B2
(45) Date of Patent: Aug. 30, 2016

(54) ELECTROMAGNETIC MASSAGE DEVICE FOR BATHTUB OR POOL

(71) Applicant: GUANGZHOU RISING DRAGON ELECTRONICS & PLASTICS TECHNOLOGY CO., LTD., Guangzhou (CN)

(72) Inventor: Boen Ma, Guangzhou (CN)

(73) Assignee: GUANGZHOU RISING DRAGON ELECTRONICS & PLASTICS TECHNOLOGY CO., LTD., Guangzhou (CN)

( * ) Notice: Subject to any disclaimer, the term of this patent is extended or adjusted under 35 U.S.C. 154(b) by 311 days.

(21) Appl. No.: 14/345,869

(22) PCT Filed: Dec. 30, 2012

(86) PCT No.: PCT/CN2012/087955
§ 371 (c)(1),
(2) Date: Mar. 19, 2014

(87) PCT Pub. No.: WO2013/170617
PCT Pub. Date: Nov. 21, 2013

(65) Prior Publication Data

US 2014/0230138 A1 Aug. 21, 2014

(30) Foreign Application Priority Data

May 15, 2012 (CN) ..... 2012 1 0149540

(51) Int. Cl.
*A47K 3/00* (2006.01)
*A61H 33/00* (2006.01)
*A61H 23/02* (2006.01)

(52) U.S. Cl.
CPC ..... *A61H 33/0087* (2013.01); *A61H 23/0218* (2013.01); *A61H 33/6089* (2013.01); *A61H 33/6094* (2013.01); *A61H 33/6063* (2013.01)

(58) Field of Classification Search
CPC ..... A61H 33/0087; A61H 23/0218; A61H 33/6089; A61H 33/6094
USPC ..... 4/541.1–541.6
See application file for complete search history.

(56) References Cited

FOREIGN PATENT DOCUMENTS

| | | |
|---|---|---|
| CN | 85201921 U | 1/1987 |
| CN | 2414746 Y | 1/2001 |
| CN | 2593134 Y | 12/2003 |

(Continued)

OTHER PUBLICATIONS

PCT/CN2012/087955 International Search Report dated Apr. 18, 2013.

*Primary Examiner* — Huyen Le
*Assistant Examiner* — Christine Skubinna
(74) *Attorney, Agent, or Firm* — Maier & Maier, PLLC

(57) ABSTRACT

An electromagnetic massage device for bathtub or pool includes an integrated holder for being fixed in a mounting hole; a lock nut engaging a thread on a wall on the holder, that fastens the holder to the surface of the wall; a rubber case with a top portion that bulges outward and a bottom portion with a rim which fits to the base plate of the concave cavity of the holder to seal the opening of the upper end of the holder; a conductive coil provided in the ring cavity of the holder and encapsulated by an upper magnetic conductive cover, a lower magnetic conductive cover and a magnetic conductive shell; and a beating head and an armature fastened together and mounted in the guide cavity of the holder to slide in the guide cavity under the action of an electromagnetic field.

11 Claims, 3 Drawing Sheets

(56) References Cited

FOREIGN PATENT DOCUMENTS

| | | | |
|---|---|---|---|
| CN | 2607935 | Y | 3/2004 |
| CN | 201033149 | Y | 3/2008 |
| CN | 101773447 | A | 7/2010 |
| CN | 201618085 | U | 11/2010 |
| CN | 201879573 | U | 6/2011 |
| CN | 201939207 | U | 8/2011 |
| CN | 102429601 | A | 5/2012 |
| CN | 102648887 | A | 8/2012 |
| CN | 202620167 | U | 12/2012 |
| DE | 3635663 | A1 | 5/1988 |
| JP | 11074115 | A | 3/1999 |
| JP | 2004-89477 | A | 3/2004 |

ELECTROMAGNETIC MASSAGE DEVICE FOR BATHTUB OR POOL

FIELD OF THE INVENTION

The present disclosure relates generally to an electromagnetic massage device, and specifically to an electromagnetic massage device for a bathtub or pool.

BACKGROUND OF THE INVENTION

With the improvement of people's living standards, people expect to add new healthy function in the traditional bathtub or pool, such as massage function. A massage device can be considered to be mounted in the bathtub or pool in order to conduct massage in the water.

At present, the massage device mounted in the bathtub or pool is usually a water-spraying type massage device. This kind of massage device is usually composed of a water pump, a massage nozzle, an inlet tube and an intake pipe. By opening the water pump, a mixed gas-liquid flow will be sprayed to a human body from the massage nozzle in the bathtub for massage. However, this style of massage device has many problems, such as large power consumption, small kinetic energy for massage, poor massage effect, and the pipeline can easily store standing water that results in bacteria regrowth and brings secondary pollution.

Therefore, it is necessary to develop a massage device more appropriate for bathtub or pool. Currently, there is no other type of massage device for bathtub or pool in the industry.

SUMMARY OF THE INVENTION

The object of the present disclosure is to provide an electromagnetic massage device for bathtub or pool, the electromagnetic massage device has many advantages, such as large kinetic energy, long service life, low energy consumption, good massage effect, no standing water in the pipeline and easily to achieve intelligent control.

According to an aspect of the present disclosure, the electromagnetic massage device for bathtub or pool is mounted in the bathtub or pool through a mounting hole in the wall of the bathtub or pool. The electromagnetic massage device includes an integrated holder suitable for being fixed in the mounting hole in the wall of the bathtub or pool, where one end of the holder that enters into the wall of the bathtub or pool is called upper end, and the opposing end that comes out from the wall of the bathtub or pool is called lower end, wherein a concave cavity is formed in the opening of the upper end of the holder, the bottom of the concave cavity is a circular base plate. The center of the circular base plate extends inside to form a guide cavity. A ring cavity is formed between the circular base plate and the opening of the lower end of the holder surrounding the guide cavity, the edge of the concave cavity turns inside out to form a buckled side, which is attached tightly against the internal surface of the wall of the bathtub or pool, and the peripheral wall of the lower end of the holder is provided with a external thread. A lock nut engaging to the external thread on the peripheral wall of the lower end of the holder, configured to fasten the lower end of the holder to the outside surface of the wall of the bathtub or pool. A rubber case, where the top portion of the rubber case bulges outward and the bottom portion of the rubber case is provided with a circular folded rim which is fit closely to the circular base plate of the concave cavity of the holder to seal the opening of the upper end of the holder. A conductive coil provided in the ring cavity of the holder and encapsulated by an upper magnetic conductive cover, a lower magnetic conductive cover and a magnetic conductive shell. And a beating head and an armature both of which are fastened together and mounted in the guide cavity of the holder, wherein the beating head and armature slide back and forth in the guide cavity under the action of the electromagnetic field caused by the conductive coil so that the beating head can slide into the concave cavity from the guide cavity and enter into the rubber case, or the beating head can enter into the guide cavity from the rubber case and return to the guide cavity.

Preferably, a seal ring is provided between the buckled side of the upper end of the holder and the inside surface of the wall of the bathtub or pool.

Preferably, the electromagnetic massage device also includes a gland nut, and the peripheral wall of the concave cavity of the holder is provided with an internal thread, so the folded rim of the rubber case can be fastened to the circular base plate of the concave cavity by the cooperation between the gland nut and the internal thread.

Preferably, a gasket is provided between the gland nut and the folded rim of the rubber case.

Preferably, a cushion is provided on the base plate of the guide cavity of the holder to reduce the vibration and noise caused by the armature in movement.

Preferably, the inner wall of the guide cavity is provided with a gas vent along direction perpendicular to the axis, and the base plate of the guide cavity is provided with a discharge hole.

Preferably, the beating head and the armature are provided with discharge channels along direction perpendicular to the axis.

Preferably, the device also includes a cable and a wire connected with the conductive coil configured to provide pulse current to the conductive coil to generate an electromagnetic field.

Preferably, the opening of the lower end of the holder is sealed by epoxy resin to fasten the coil assembly and seal the charged device.

According to a further aspect of the present disclosure, the present disclosure also provides an electromagnetic massage system, including one to twelve sets of electromagnetic massage devices according to the present disclosure and intelligent control software to support the use of the electromagnetic massage device. The electromagnetic massage device can be controlled by the software to run in the preprogrammed multiple modes and strengths to achieve the effects of simulated hand massage.

The electromagnetic massage device for bathtub or pool of the present disclosure has the following features and benefits.

1. The electromagnetic massage device is a massage device based on the principle of electromagnetism. While the conductive coil is switched on by pulse current, the armature drives the beating head to do reciprocating movement in the guide cavity, that is, the combination of the armature and the beating head slides to the upward side of the guide cavity under the influence of a magnetic field, enters into the rubber case, knocks on the rubber case, falls back to the cavity from the rubber case, returns to the guide cavity, and such reciprocating motion can have a knocking massage effect for a person in the water. This kind of electromagnetic massage device has a simple structure, lasting power and long service life.

2. The holder used by the electromagnetic massage device is integrated formed, which has better sealing and waterproof effects for mounted components. The upper end of the holder that the end of the holder entering into the wall of the bathtub or pool is generally immersed in water, and the holder can be very efficiently prevented from permeation and immersion of water due to the specific rubber case and the composite structure of the buckled side and the seal ring. The guide cavity of the holder provides a space for the movement of the armature, and the cavity wall of the holder also provides a second protection from leaking.

3. The rubber case used in the electromagnetic massage device has three different kinds of influences, including cushioning the knock on the human body by the knocking head, limiting the armature keeping moving upwards and assisting the reset of the armature, and insulating the guide cavity from liquid to achieve liquid sealing effect to avoid liquid leaking.

DETAILED DESCRIPTION OF THE INVENTION

In the following description of embodiments, reference is made to the accompanying drawings which form a part hereof, and in which it is shown by way of illustration specific embodiments of the present disclosure that can be practiced. It is to be understood that other embodiments can be used and structural changes can be made without departing from the scope of the disclosed embodiments.

Figure 1:
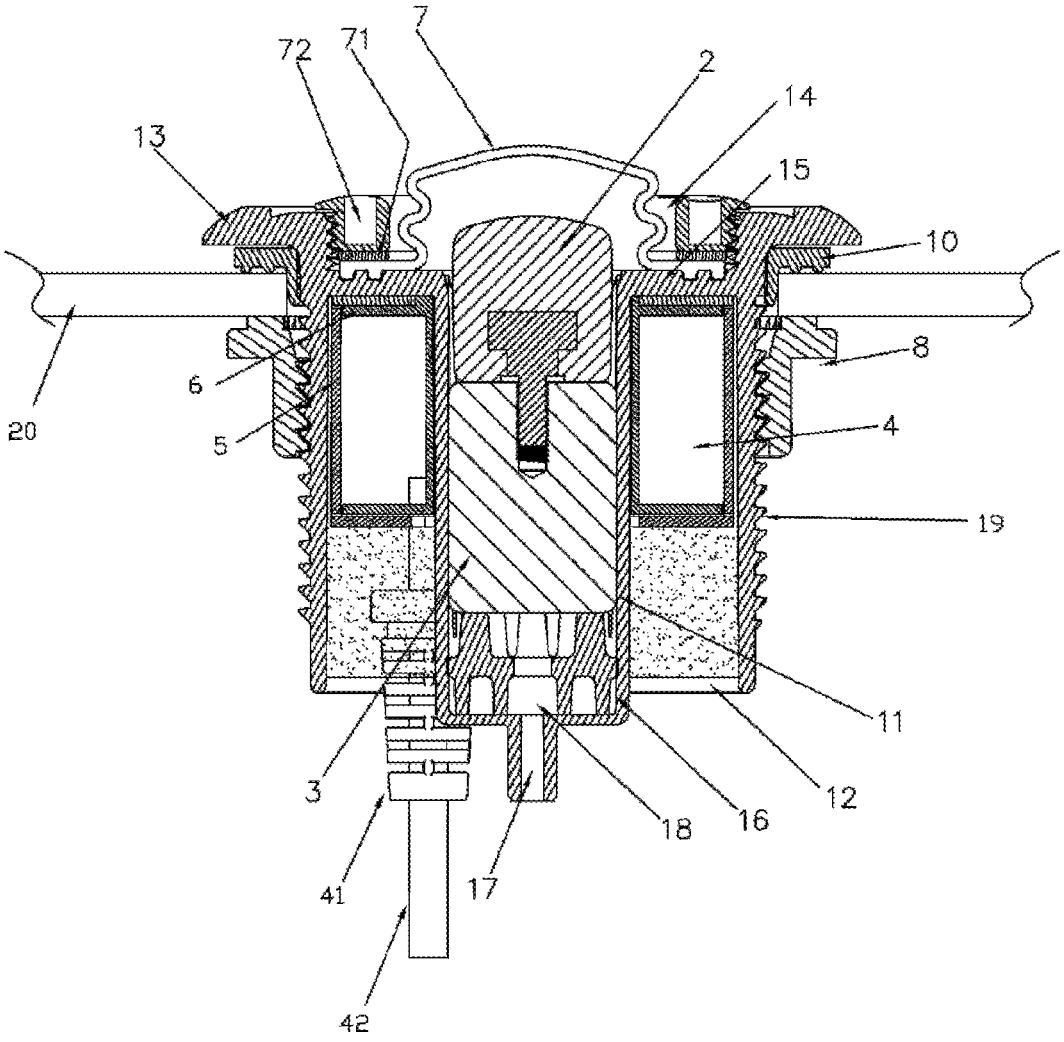
FIG. 1 is a section view illustrating an electromagnetic massage device for bathtub or pool according to one embodiment of the present disclosure.
Figure 2:
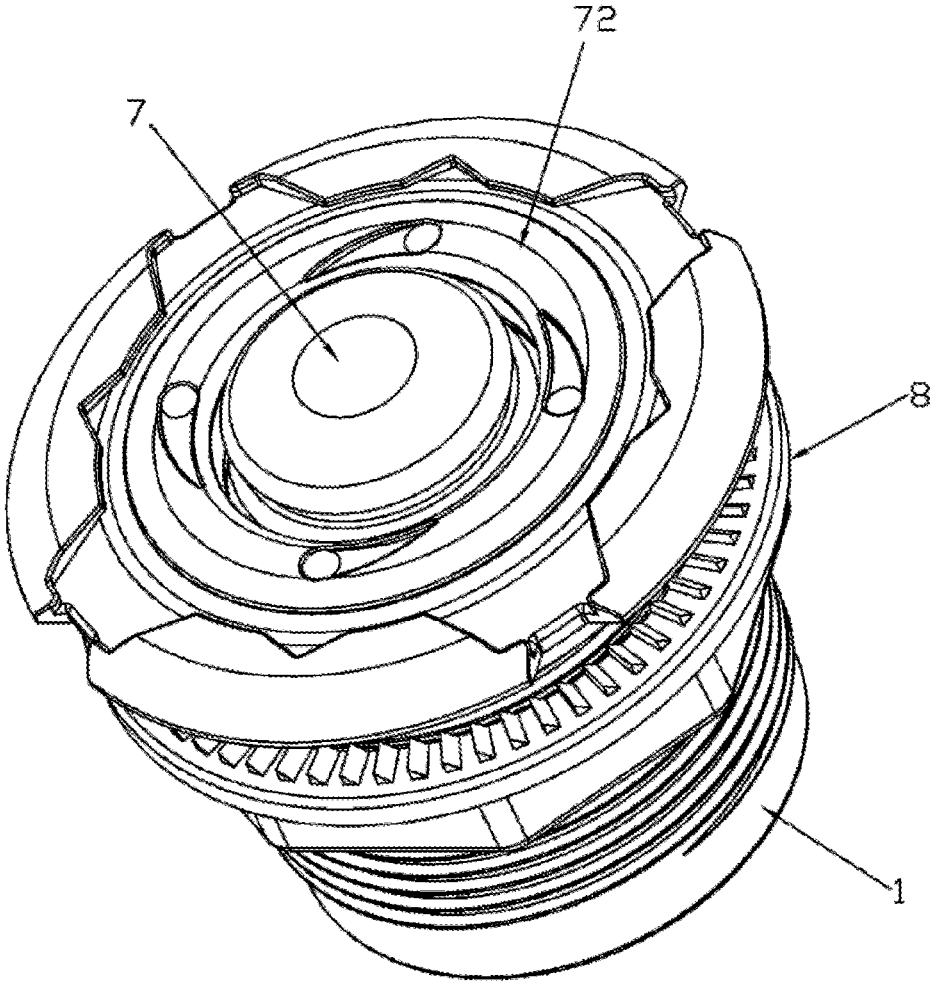
FIG. 2 is a stereogram illustrating an electromagnetic massage device for bathtub or pool according to one embodiment of the present disclosure.
Figure 3:
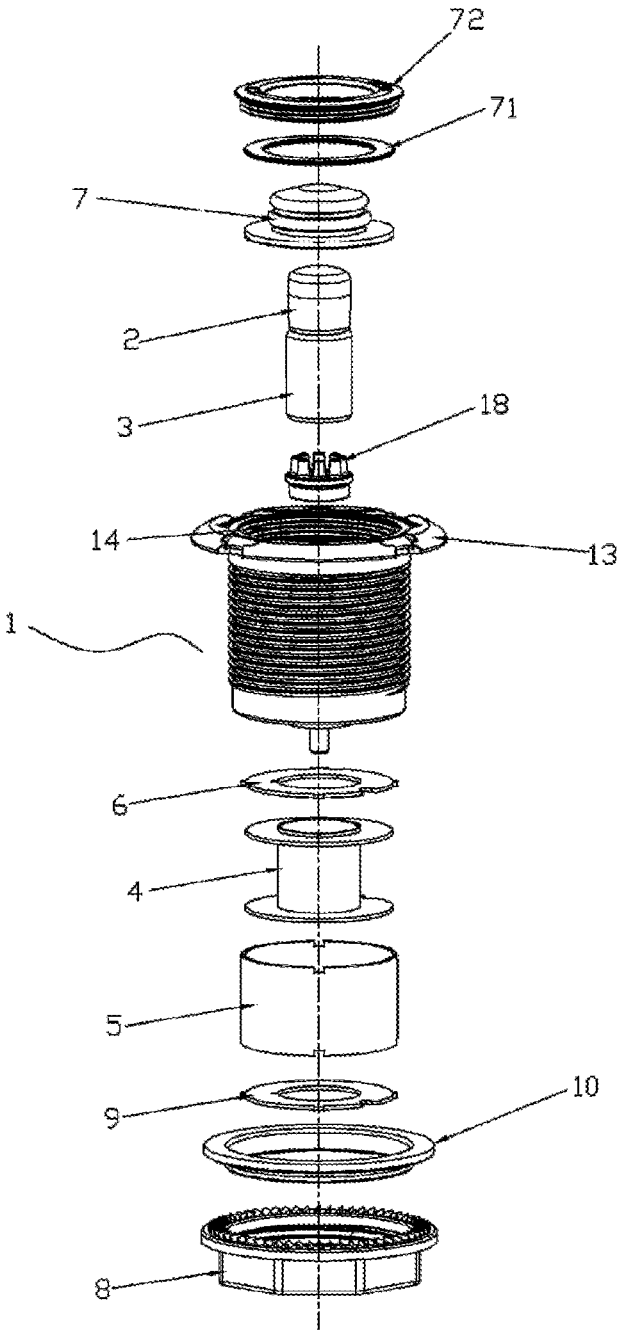
FIG. 3 is an exploded view illustrating an electromagnetic massage device for bathtub or pool according to one embodiment of the present disclosure.

In one embodiment of the present disclosure, as shown in FIGS. 1-3, an electromagnetic massage device for bathtub or pool of the present disclosure is mounted in the bathtub or pool through a mounting hole in the wall 20 of the bathtub or pool.

The electromagnetic massage device includes an integrated holder 1 suitable for being fixed in the mounting hole in the wall 20 of the bathtub or pool, where one end of the holder 1 that enters into the wall 20 of the bathtub or pool is called upper end, and the opposing end that comes out from the wall 20 of the bathtub or pool is called lower end, wherein a concave cavity 14 is formed in the opening of the upper end of the holder 1, the bottom of the concave cavity 14 is a circular base plate 15, the center of the circular base plate 15 extends inside to form a guide cavity 11, a ring cavity 12 is formed between the circular base plate 15 and the opening of the lower end of the holder 1 surrounding the guide cavity 12, the edge of the concave cavity 14 turns inside out to form a buckled side 13 which is attached tightly against the internal surface of the wall 20 of the bathtub or pool, and the peripheral wall of the lower end of the holder 1 is provided with a external thread 19. The electromagnetic massage device also includes a lock nut 8 engaging to the external thread 19 on the lower end of the holder 1 to fasten the lower end of the holder 1 to the outside surface of the wall 20 of the bathtub or pool. The electromagnetic massage device also includes a rubber case 7, where the top portion of the rubber case bulges outward and the bottom portion of the rubber case is provided with a circular folded rim which is fit closely to the circular base plate 15 of the concave cavity 14 of the holder 1 to seal the opening of the upper end of the holder 1. The electromagnetic massage device also includes a conductive coil 4 provided in the ring cavity 12 of the holder 1 and encapsulated by an upper magnetic conductive cover 6, a lower magnetic conductive cover 9 and a magnetic conductive shell 5. The electromagnetic massage device also includes a knocking head 2 and an armature 3 both of which are fastened together (in the embodiment as shown in FIG. 1, the knocking head 2 and the armature 3 are connected by a built-in screw) and mounted in the guide cavity 11 of the holder 1, wherein the knocking head 2 and armature 3 slide back and forth in the guide cavity 11 under the action of the electromagnetic field caused by the conductive coil 4 that the knocking head 2 can slide into the concave cavity 14 from the guide cavity 11 and enter into the rubber case 7, or the knocking head 2 can enter into the guide cavity 14 from the rubber case 7 and return to the guide cavity 11.

As shown in FIG. 1 and FIG. 3, a seal ring 10 is provided between the buckled side 13 of the upper end of the holder 1 and the inside surface of the wall 20 of the bathtub or pool, so as to provide better liquid sealing effect.

As shown in FIG. 1 and FIG. 3, the electromagnetic massage device also includes a gland nut 72, and the peripheral wall of the concave cavity 14 of the holder 1 is provided with an internal thread, so the folded rim of the rubber case 7 can be fastened to the circular base plate 15 of the concave cavity 14 by the cooperation between the gland nut 72 and the internal thread. The above structure can provide better liquid sealing effect.

As shown in FIG. 1 and FIG. 3, a gasket 71 is provided between the gland nut 72 and the folded rim of the rubber case 7, so as to provide better liquid sealing effect.

As shown in FIG. 1 and FIG. 3, a cushion 18 is provided on the base plate of the guide cavity 11 of the holder 1 to reduce the vibration and noise caused by the armature 3 in movement.

As shown in FIG. 1, the inner wall of the guide cavity 11 is provided with a gas vent 16 along direction perpendicular to the axis, and the base plate of the guide cavity 11 is provided with a discharge hole 17. With the structure, the guide cavity 11 is kept under atmospheric pressure to make the knocking head 2 and armature 3 move in the guide cavity 11 without block by stress change to achieve resistanceless motion.

In order to further reduce the resistance of movement, the knocking head 2 and the armature 3 are provided with discharge channels along direction perpendicular to the axis.

As shown in FIG. 1, the electromagnetic massage device also includes a cable 41 and a wire 42 connected with the conductive coil 4 configured to provide pulse current to the conductive coil 4 to generate an electromagnetic field.

As shown in FIG. 1, the opening of the lower end of the holder 1 is sealed by epoxy resin to fasten the coil assembly and seal the charged device to play the weather proof, dustproof, insulation, anti-corrosion, temperature resistance and quakeproof role.

Based on the above electromagnetic massage device, the present disclosure also provides an electromagnetic massage system, including one to twelve sets of electromagnetic massage devices according to the present disclosure and intelligent control software to support the use of the electromagnetic massage device, and the electromagnetic massage device can be controlled by the software to run in the preprogrammed multiple modes and strength to achieve the effects to simulate hand massage.

The described embodiments of the present disclosure are presented for the purpose of illustration, not limitation. Those skilled in the art will recognize that the present disclosure can be practiced with modification within the spirit and scope of the claims.

What is claimed is:

1. An electromagnetic massage device for a bathtub or pool, mounted in a bathtub or pool through a mounting hole in a wall of the bathtub or pool, comprising:

an integrated holder configured to be fixed in the mounting hole in the wall of the bathtub or pool, wherein one end of the holder that enters into the wall of the bathtub or pool is called upper end, and the opposing end that comes out from the wall of the bathtub or pool is called lower end, wherein a concave cavity is formed in the opening of the upper end of the holder, the bottom of the concave cavity is a circular base plate, the center of the circular base plate extends inside to form a guide cavity, a ring cavity surrounding the guide cavity is formed between the circular base plate and the opening of the lower end of the holder, an edge of the concave cavity turns inside out to form a buckled side which is attached tightly against the internal surface of the wall of the bathtub or pool, and the peripheral wall of the lower end of the holder is provided with an external thread;

a lock nut engaging to the external thread on the peripheral wall of the lower end of the holder, configured to fasten the lower end of the holder to the outside surface of the wall of the bathtub or pool;

a rubber case, having a top portion that bulges outward and a bottom portion that is provided with a circular folded rim which is fit closely to the circular base plate of the concave cavity of the holder to seal the opening of the upper end of the holder;

a conductive coil provided in a magnetic conductive shell of the ring cavity of the holder; and a beating head and an armature, both of which are fastened together and mounted in the guide cavity of the holder, wherein the beating head and armature are arranged to slide back and forth in the guide cavity under the action of the electromagnetic field caused by the conductive coil so that the beating head can slide into the concave cavity from the guide cavity and enter into the rubber case, or the beating head can enter into the guide cavity from the rubber case and return to the guide cavity.

2. The electromagnetic massage device for a bathtub or pool of claim 1, wherein an upper opening and a lower opening of the magnetic conductive shell are provided with an upper magnetic conductive cover and a lower magnetic conductive cover respectively, and the conductive coil is encapsulated by the upper magnetic conductive cover, the lower magnetic conductive cover and the magnetic conductive shell.

3. The electromagnetic massage device for a bathtub or pool of claim 1, wherein a seal ring is provided between the buckled side of the upper end of the holder and the inside surface of the wall of the bathtub or pool.

4. The electromagnetic massage device for a bathtub or pool of claim 1, wherein the electromagnetic massage device also comprises a gland nut, and the peripheral wall of the concave cavity of the holder is provided with an internal thread, so the folded rim of the rubber case can be fastened to the circular base plate of the concave cavity by the cooperation between the gland nut and the internal thread.

5. The electromagnetic massage device for a bathtub or pool of claim 4, wherein a gasket is provided between the gland nut and the folded rim of the rubber case.

6. The electromagnetic massage device for a bathtub or pool of claim 1, wherein a cushion is provided on the base plate of the guide cavity of the holder to reduce vibration and noise caused by the armature in movement.

7. The electromagnetic massage device for a bathtub or pool of claim 1, wherein the inner wall of the guide cavity is provided with a gas vent along direction perpendicular to the axis, and the base plate of the guide cavity is provided with a discharge hole.

8. The electromagnetic massage device for a bathtub or pool of claim 1, wherein the beating head and the armature are provided with discharge channels along directions perpendicular to the axis.

9. The electromagnetic massage device for a bathtub or pool of claim 1, comprising a cable and a wire connected with the conductive coil configured to provide pulse current to the conductive coil to generate an electromagnetic field.

10. The electromagnetic massage device for a bathtub or pool of claim 1, wherein the opening of the lower end of the holder is sealed by epoxy resin to fasten the coil assembly and seal the charged device.

11. An electromagnetic massage system, comprising the electromagnetic massage device according to claim 1, and intelligent control software to support the use of the electromagnetic massage device, wherein the electromagnetic massage device is controlled by the software to run in the preprogrammed multiple modes and strength to achieve the effects to simulate hand massage.

* * * * *